US011682853B2

(12) United States Patent
Henry et al.

(10) Patent No.: US 11,682,853 B2
(45) Date of Patent: Jun. 20, 2023

(54) ELECTRICAL CONNECTOR ASSEMBLY HAVING A CONNECTOR MOUNTING BRACKET

(71) Applicant: TE Connectivity Services GmbH, Schaffhausen (CH)

(72) Inventors: Randall Robert Henry, Lebanon, PA (US); Brandon Michael Matthews, McAlisterville, PA (US)

(73) Assignee: TE CONNECTIVITY SOLUTIONS, GMBH, Schaffhausen (CH)

( * ) Notice: Subject to any disclaimer, the term of this patent is extended or adjusted under 35 U.S.C. 154(b) by 72 days.

(21) Appl. No.: 17/308,639

(22) Filed: May 5, 2021

(65) Prior Publication Data

US 2022/0360001 A1 Nov. 10, 2022

(51) Int. Cl.
*H01R 12/72* (2011.01)
*H01R 13/506* (2006.01)

(52) U.S. Cl.
CPC ..... *H01R 12/721* (2013.01); *H01R 13/506* (2013.01)

(58) Field of Classification Search
CPC ..... H01R 12/721; H01R 13/506
USPC ..... 439/634
See application file for complete search history.

(56) References Cited

U.S. PATENT DOCUMENTS 3,432,802 A * 3/1969 Ritchie ..... H01R 13/506 439/690
4,477,047 A 10/1984 Pelczarski
5,088,935 A 2/1992 Dise et al.
5,380,223 A * 1/1995 Marsh ..... H01R 13/6582 439/357
5,709,569 A * 1/1998 Buck ..... H01R 13/745 439/939
5,772,471 A * 6/1998 Buck ..... H01R 13/745 439/939
6,074,222 A * 6/2000 Kuo ..... H01R 13/748 439/939
6,176,738 B1 * 1/2001 Consoli ..... H01R 13/741 439/552
6,206,731 B1 * 3/2001 Kuo ..... H01R 13/6582 439/939
6,231,384 B1 * 5/2001 Kuo ..... H01R 13/6582 439/939

(Continued)

FOREIGN PATENT DOCUMENTS

CN 101237087 B * 10/2010
DE 102018202955 A1 * 8/2019 ..... H01R 13/03

*Primary Examiner* — Peter G Leigh

(57) ABSTRACT

An electrical connector assembly includes a housing having a card slot at a mating end configured to pass through a panel opening of a panel forward of the panel for receiving a circuit card. A cable end of the housing is rearward of the panel. The electrical connector assembly includes contacts held in the housing. The electrical connector assembly includes cables terminated to the contacts and extending from the housing. The electrical connector assembly includes a connector mounting bracket having a collar surrounding a window receiving the housing. The connector mounting bracket has mounting latches extending from the collar with latch fingers configured to be coupled to the panel. The connector mounting bracket includes a biasing element configured to engage the panel to bias the panel against the mounting latches.

20 Claims, 4 Drawing Sheets

(56) References Cited

U.S. PATENT DOCUMENTS

| | | | | |
|---|---|---|---|---|
| 6,231,385 | B1 * | 5/2001 | Kuo | H01R 13/745 439/939 |
| 6,257,913 | B1 | 7/2001 | Kropa et al. | |
| 6,312,285 | B1 * | 11/2001 | Berg | H01R 13/74 439/545 |
| 6,450,834 | B1 * | 9/2002 | Polgar | H01R 13/74 439/546 |
| 6,648,681 | B2 * | 11/2003 | Ushiro | H01R 13/743 439/562 |
| 6,659,796 | B1 * | 12/2003 | Waddell | H01R 13/745 439/352 |
| 6,709,286 | B1 * | 3/2004 | Korsunsky | H01R 13/743 439/95 |
| 6,991,494 | B1 * | 1/2006 | Spink, Jr. | H01R 13/745 439/76.1 |
| 7,435,106 | B2 * | 10/2008 | Su | H01R 13/6658 439/76.1 |
| 7,597,587 | B1 * | 10/2009 | Duesterhoeft | H01R 13/631 439/545 |
| 7,789,701 | B2 * | 9/2010 | Murr | H01R 13/743 439/552 |
| 8,014,165 | B2 * | 9/2011 | Hamner | H01R 13/6582 361/776 |
| 8,152,562 | B2 | 4/2012 | Gross | |
| 9,113,568 | B2 | 8/2015 | Rossman | |
| 9,172,176 | B2 * | 10/2015 | Chen | H01R 13/582 |
| 10,591,682 | B1 | 3/2020 | Grandidge | |
| 2007/0128938 | A1 * | 6/2007 | Kuo | H01R 13/745 439/607.41 |
| 2013/0065432 | A1 * | 3/2013 | Fu | H01R 13/748 439/569 |

* cited by examiner

ELECTRICAL CONNECTOR ASSEMBLY HAVING A CONNECTOR MOUNTING BRACKET

BACKGROUND OF THE INVENTION

The subject matter herein relates generally to electrical connector assemblies.

Electrical connector assemblies are used to interconnect components for data communication between the components. Some known electrical connector assemblies are mounted to circuit boards. Other known electrical connector assemblies are cable mounted.

A need remains for a cost effective and reliable manner of holding cable connector assemblies in fixed positions for mating with mating electrical connectors.

BRIEF DESCRIPTION OF THE INVENTION

In one embodiment, an electrical connector assembly configured to be mounted to a panel in a panel opening is provided. The electrical connector assembly includes a housing having a mating end and a cable end. The housing has a card slot at the mating end configured to receive a circuit card. The mating end configured to pass through the panel opening and presented forward of the panel for receiving the circuit card. The housing is configured to extend from the panel with the cable end rearward of the panel. The electrical connector assembly includes contacts held in the housing. The contacts have mating ends provided at the card slot for mating with the circuit card. The contacts have terminating ends opposite the mating ends. The electrical connector assembly includes cables terminated to the terminating ends of corresponding contacts. The cables extend from the cable end of the housing. The electrical connector assembly includes a connector mounting bracket having a collar surrounding the housing. The collar has a window receiving the housing. The connector mounting bracket has mounting latches extending from the collar. The mounting latches includes latch fingers configured to be coupled to the panel to secure the connector mounting bracket to the rear of the panel. The connector mounting bracket includes a biasing element configured to engage the panel to bias the panel against the mounting latches.

In another embodiment, an electrical connector assembly configured to be mounted to a panel in a panel opening is provided. The electrical connector assembly includes a housing having a mating end and a cable end. The housing has a card slot at the mating end configured to receive a circuit card. The mating end is configured to pass through the panel opening and presented forward of the panel for receiving the circuit card. The housing configured to extend from the panel with the cable end rearward of the panel. The electrical connector assembly includes contacts held in the housing. The contacts have mating ends provided at the card slot for mating with the circuit card. The contacts have terminating ends opposite the mating ends. The electrical connector assembly includes cables terminated to the terminating ends of corresponding contacts. The cables extend from the cable end of the housing. The electrical connector assembly includes a cable holder coupled to the cable end of the housing. The cable holder surrounding the cables and providing strain relief for the cables. The electrical connector assembly includes a connector mounting bracket having a collar surrounding the housing. The collar has a window receiving the housing. The connector mounting bracket has mounting latches extending from the collar. The mounting latches includes latch fingers configured to be coupled to the panel to secure the connector mounting bracket to the rear of the panel. The connector mounting bracket includes a biasing element configured to engage the panel to bias the panel against the mounting latches, wherein the collar of the connector mounting bracket is captured between the housing and the cable holder.

In a further embodiment, an electrical connector assembly configured to be mounted to a panel in a panel opening is provided. The electrical connector assembly includes a housing having a mating end and a cable end. The housing has a card slot at the mating end configured to receive a circuit card. The mating end configured to pass through the panel opening and presented forward of the panel for receiving the circuit card. The housing is configured to extend from the panel with the cable end rearward of the panel. The electrical connector assembly includes contacts held in the housing. The contacts have mating ends provided at the card slot for mating with the circuit card. The contacts have terminating ends opposite the mating ends. The electrical connector assembly includes cables terminated to the terminating ends of corresponding contacts. The cables extending from the cable end of the housing. The electrical connector assembly includes a connector mounting bracket having a collar surrounding the housing. The collar extending between a first side and a second side. The collar has a front and a rear. The collar has a window between the front and the rear. The window receiving the housing. The connector mounting bracket includes a stabilizing feature configured to engage the panel to stabilize the collar relative to the panel. The connector mounting bracket has a first mounting latch at the first side and a second mounting latch at the second side. The first and second mounting latches extending forward from the front of the collar to secure the connector mounting bracket to the rear of the panel. The connector mounting bracket includes a biasing element configured to engage the panel to bias the panel against the mounting latches.

DETAILED DESCRIPTION OF THE INVENTION

Figure 1:
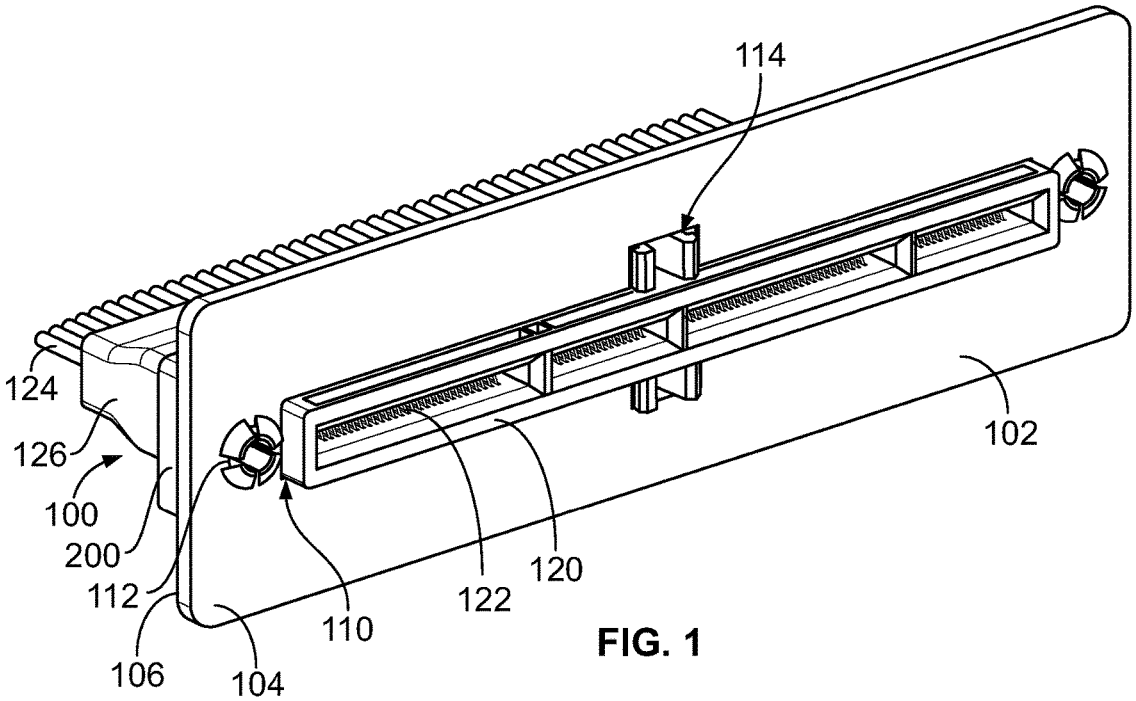
FIG. 1 is a front perspective view of an electrical connector assembly in accordance with an exemplary embodiment.
Figure 2:
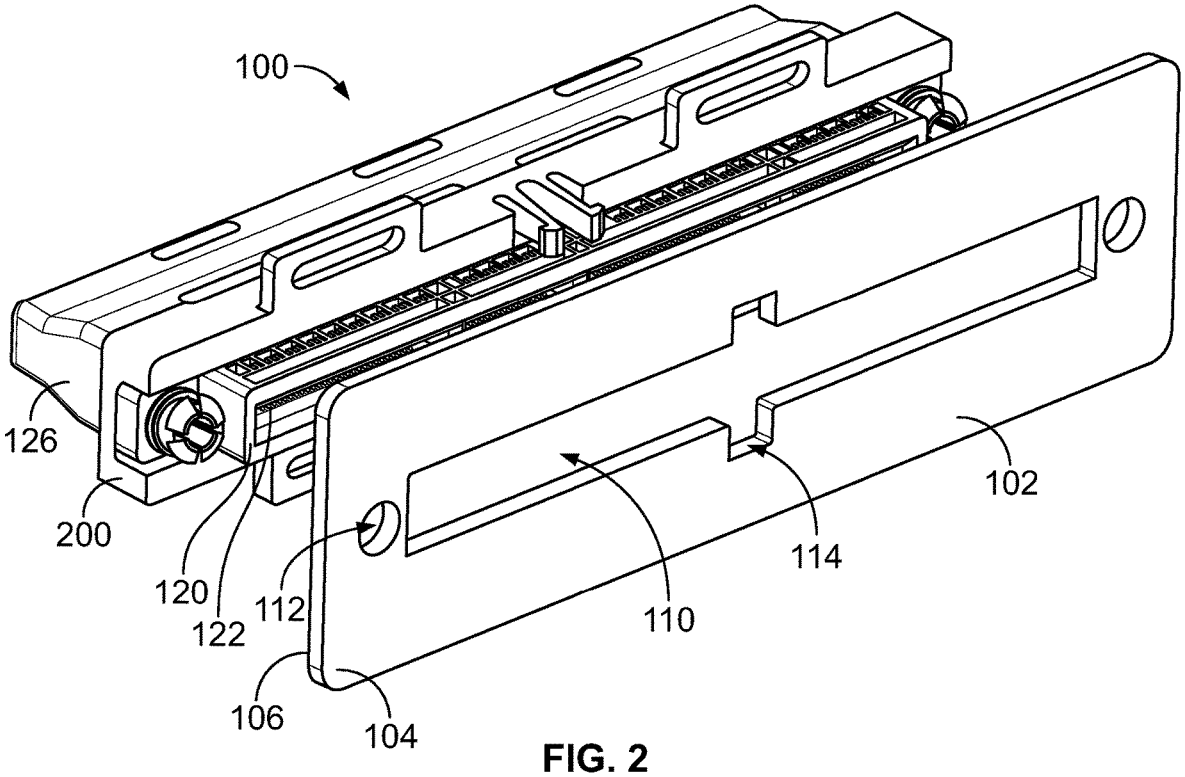
FIG. 2 is a front perspective view of the electrical connector assembly in accordance with an exemplary embodiment.

FIG. 1 is a front perspective view of an electrical connector assembly 100 in accordance with an exemplary embodiment showing the electrical connector assembly 100 coupled to a panel 102. FIG. 2 is a front perspective view of the electrical connector assembly 100 in accordance with an exemplary embodiment showing the electrical connector assembly 100 poised for coupling to the panel 102. In an exemplary embodiment, the electrical connector assembly 100 is configured to be mounted to the panel 102 without the use of additional mounting hardware. In an exemplary embodiment, the electrical connector assembly 100 is configured to be mounted to the panel 102 without the use of additional tooling. In an exemplary embodiment, the electrical connector assembly 100 is configured to be snap coupled or clipped to the panel 102 from behind the panel 102 using integral latching features built into the electrical connector assembly 100.

The panel 102 may be part of a computer bezel or other electronic device. The panel 102 may be generally planar having a front 104 and a rear 106. The panel 102 includes a panel opening 110 through the panel 102. In the illustrated embodiment, the panel opening 110 is an elongated slot. The panel opening 110 may be elongated in a horizontal direction. Other orientations are possible in alternative embodiments. In the illustrated embodiment, the panel opening 110 is generally rectangular in shape. Other shapes are possible in alternative embodiments.

In an exemplary embodiment, the panel 102 includes one or more notches in the panel opening 110 defining the latch openings 112 configured to receive corresponding latches of the electrical connector assembly 100. In the illustrated embodiment, the latch openings 112 are provided at a top and a bottom of the panel opening 110. The latch openings 112 may be approximately centered between right and left sides of the panel opening 110. Other locations are possible in alternative embodiments. In other various embodiments, greater or fewer latch openings 112 may be provided.

In an exemplary embodiment, the panel 102 includes one or more mounting openings 114 through the panel 102. The mounting openings 114 are configured to receive corresponding latches of the electrical connector assembly 100. In the illustrated embodiment, the mounting openings 114 are provided at first and second sides of the panel opening 110. The mounting openings 114 are spaced slightly apart from the panel opening 110 such that material of the panel 102 is located between the panel opening 110 and the mounting openings 114. Other locations are possible in alternative embodiments. In other various embodiments, greater or fewer mounting openings 114 may be provided.

In an exemplary embodiment, the electrical connector assembly 100 is rear loaded into the panel opening 110. The latching features of the electrical connector assembly 100 are snap coupled to the panel 102. For example, the latching features extend through the latch openings 112 and the mounting openings 114 to engage the front 104 of the panel 102. Optionally, the latching features may include guide surfaces to guide the latching features into the latch openings 112 and the mounting openings 114. The latching features are deflectable such that the latching features are initially squeezed together to pass through the latch openings 112 and the mounting openings 114 until the latching features clear the front 104 of the panel 102. Once the latching features clear the front 104, the latching features may snap into the latched positions to secure the electrical connector assembly 100 to the panel 102. In an exemplary embodiment, the latching features may be self-centering within the latch openings 112 and the mounting openings 114 to position the electrical connector assembly 100 relative to the panel 102. A portion of the electrical connector assembly 100 passes through the panel opening 110 that is exposed forward of the panel 102, such as for mating with a mating electrical connector. Other portions of the electrical connector assembly 100 extend rearward of the panel 102. The electrical connector assembly 100 is self-supported on the panel 102 when coupled thereto without the need for additional mounting hardware, such as screws or fasteners.

In an exemplary embodiment, the electrical connector assembly 100 includes a housing 120 holding a plurality of contacts 122. In an exemplary embodiment, the electrical connector assembly 100 is a cable connector assembly having a plurality of cables 124 electrically connected to the corresponding contacts 122 and extending rearward from the housing 120. The cables 124 may exit in other directions, such as from the bottom and/or the top of the housing 120 in alternative embodiments. In an exemplary embodiment, the electrical connector assembly 100 includes a cable holder 126 coupled to the housing 120 that surrounds the cables 124. The cable holder 126 may provide strain relief for the cables 124. In an exemplary embodiment, the electrical connector assembly 100 includes a connector mounting bracket 200 separate and discrete from the housing 120 and coupled to the housing 120. The connector mounting bracket 200 is used to couple the electrical connector assembly 100 to the panel 102. The connector mounting bracket 200 includes latching features configured to be separably coupled to the panel 102. The connector mounting bracket 200 is preassembled with the housing 120 to form the electrical connector assembly 100, which is coupled to the panel 102.

In an exemplary embodiment, the electrical connector assembly 100 is a cable mounted card edge connector. The card edge connector is provided at an end of the cables 124 to form a mating interface with the mating electrical connector. The electrical connector assembly 100 includes one or more card slots configured to receive one or more circuit cards to electrically connect the circuit cards to the cables 124. The electrical connector assembly 100 provides an interface for the circuit cards at the panel 102.

Figure 3:
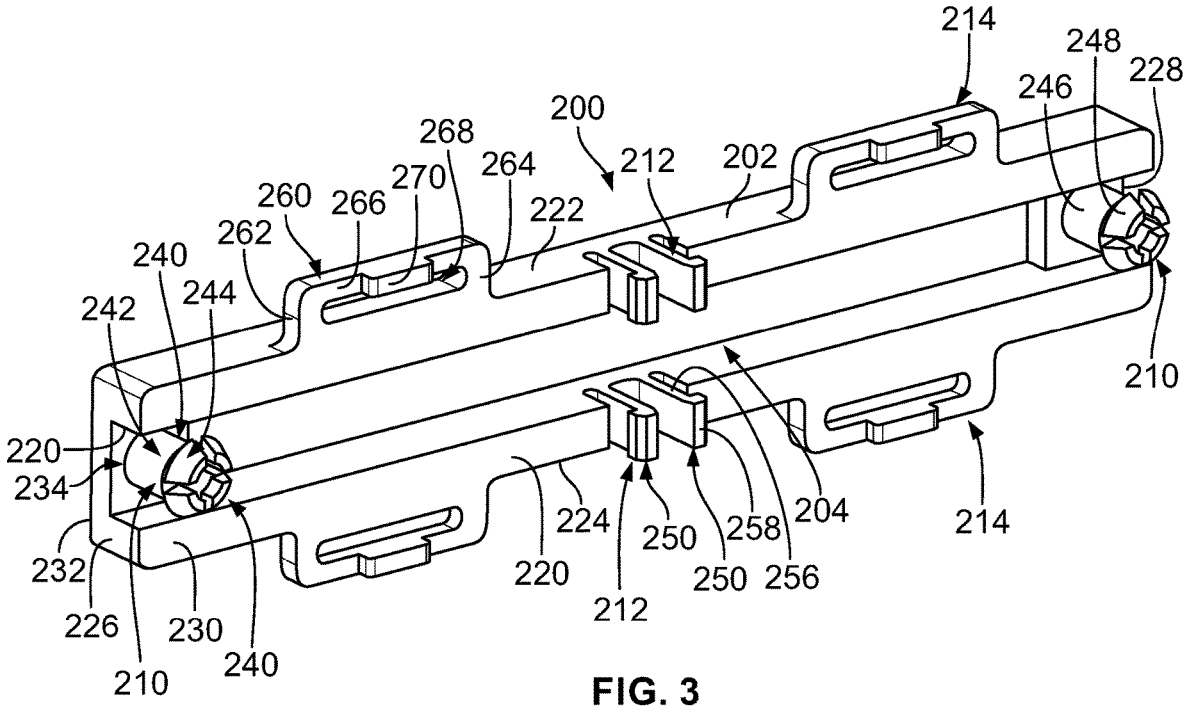
FIG. 3 is a front perspective view of a portion of the electrical connector assembly in accordance with an exemplary embodiment.

FIG. 3 is a front perspective view of a portion of the electrical connector assembly 100 in accordance with an exemplary embodiment showing the connector mounting bracket 200. The connector mounting bracket 200 includes a collar 202 surrounding a window 204, a plurality of mounting latches 210, a plurality of centering latches 212, and a plurality of stabilizing features 214. The window 204 is configured to receive the housing 120 (shown in FIG. 2). The mounting latches 210, the centering latches 212, and the stabilizing features 214 are configured to engage the panel 102 to secure the connector mounting bracket 200, and thus the housing 120, to the panel 102. In an exemplary embodiment, the connector mounting bracket 200 is manufactured from a dielectric material, such as a plastic material. The connector mounting bracket 200 may be a molded part, such as formed from an injection molding process.

The collar 202 includes a plurality of walls 220 surrounding the window 204. In the illustrated embodiment, the collar 202 is rectangular having a top wall at a top 222, a bottom wall at a bottom 224, a first side wall at a first side 226, and a second side wall at a second side 228. The side walls extend between the top and bottom walls. In the illustrated embodiment, the collar 202 is elongated horizontally such that the top and bottom 222, 224 are longer than the first and second sides 226, 228. The collar 202 may have other shapes in alternative embodiments. The collar 202 includes a front 230 and a rear 232 opposite the front 230. The window 204 extends through the collar 202 between the front 230 and the rear 232. In an exemplary embodiment, the collar 202 includes pockets 234 in the first and second side walls that are open at the front 230 and open to the window 204. Optionally, the pockets 234 may be open at the first and second sides 226, 228. The pockets 234 are configured to receive portions of the housing 120.

The mounting latches 210 extend from the walls 220 of the collar 202 for interfacing with the panel 102. In the illustrated embodiment, the connector mounting bracket 200 includes a pair of the mounting latches 210 provided at the first and second side walls. The mounting latches 210 extend forward of the front 230. The mounting latches 210 are located in the pockets 234 and are formed integrally with the collar 202. For example, the mounting latches 210 may be co-molded with the collar 202. In an exemplary embodiment, each mounting latch 210 includes a post 242 and a head 244 at the distal end of the post 242. The head 244 is an enlarged relative to the post 242. For example, the head 244 is larger in at least one of a height and a width compared to the post 242. In the illustrated embodiment, the mounting latch 210 has a generally circular cross-section. For example, the post 242 may be generally cylindrical and the head 244 may be generally frustoconical. The head 244 issues to retain the connector mounting bracket 200 on the panel 102. For example, the head 244 may pass through the panel 102 and engage the front 104 of the panel 102.

In an exemplary embodiment, each mounting latch 210 includes a plurality of latching features 240. The latching features 240 are independently movable relative to each other, such as to compress or deflected inward as the mounting latch 210 passes through the panel 102 and then expand outward once the mounting latch 210 clears the front of the panel 102. In an exemplary embodiment, each latching feature 240 includes a latch beam 246 and a latch finger 248 at the distal end of the latching beam 246. The latching beam 246 extends between the collar 202 and the latch finger 248. The latch beam 246 is cantilevered from the front of the collar 202. The latch finger 248 extends outward relative to the latch beam 246 to interface with the panel 102. The latching beams 246 of the plurality of latching features 240 together form the post 242 and the latch fingers 248 of the plurality of latching features 240 together form the head 244. The latch beams 246 are deflectable relative to each other. For example, the latch beams 246 may be deflected inward when the latch fingers 248 are pressed through the corresponding opening in the panel 102 and the latch beams 246 spring outward once the latch fingers 248 clear the front of the panel 102. The latch fingers 248 are configured to clipped onto the front of the panel 102 after springing outward. In the illustrated embodiment, four latching features 240 are grouped to form the corresponding mounting latch 210. The latching features 240 are arranged in quadrants. The latching features 240 are arranged as opposing pairs to provide opposing spring forces for self-centering of the mounting latch 210 in the opening of the panel 102. The latching features 240 provide vertical centering and horizontal centering due to the opposing spring forces in mutually perpendicular directions.

The centering latches 212 extend from the walls 220 of the collar 202 for interfacing with the panel 102. In the illustrated embodiment, the connector mounting bracket 200 includes a pair of the centering latches 212 provided at the top wall and the bottom wall. The centering latches 212 extend forward of the front 230. In an exemplary embodiment, the centering latches 212 may both the centered between the first and second side walls. However, one or both the centering latches 212 may be offset, such as for keyed mating with the panel 102. Optionally, the top wall or the bottom wall may include greater or fewer centering latches 212 in alternative embodiments. The centering latches 212 are formed integral with the collar 202. For example, the centering latches 212 may be co-molded with the collar 202.

In an exemplary embodiment, each centering latch 212 includes a plurality of latching features 250. The latching features 250 are independently movable relative to each other, such as to compress or deflected inward as the centering latch 212 passes through the panel 102 and then expand outward once the centering latch 212 clears the front of the panel 102. In an exemplary embodiment, each latching feature 250 includes a latch beam 256 and a latch finger 258 at the distal end of the latching beam 256. The latching beam 256 extends between the collar 202 and the latch finger 258. The latch beam 256 is cantilevered from the front of the collar 202. Optionally, the latch beam 256 may extend into pockets in the top and bottom walls and extend forward from the pockets forward of the front 230 of the collar 202. The latch finger 258 extends outward relative to the latch beam 256 to interface with the panel 102. The latch beams 256 are deflectable relative to each other. For example, the latch beams 256 may be deflected inward when the latch fingers 258 are pressed through the corresponding opening in the panel 102 and the latch beams 256 spring outward once the latch fingers 258 clear the front of the panel 102. The latch fingers 258 are configured to clipped onto the front of the panel 102 after springing outward. In the illustrated embodiment, each centering latch 212 includes two latching features 250 facing the first and second sides 226, 228. The latching features 250 induce opposing forces for side-to-side centering of the connector mounting bracket 200 relative to the panel 102.

The stabilizing features 214 are formed integral with the collar 202. For example, the stabilizing features 214 may be co-molded with the collar 202. The stabilizing features 214 extend from the walls 220 of the collar 202 to increase the footprint of the collar 202 and stabilize the connector mounting bracket 200 relative to the panel 102. In the illustrated embodiment, the stabilizing features 214 are provided along the top wall and the bottom wall. One or more stabilizing features 214 extend from the top 222 and one or more stabilizing features 214 extend from the bottom 224. The stabilizing features 214 increase the height of the connector mounting bracket 200. Optionally, additional stabilizing features 214 may be provided at the first side 226 and/or the second side 228. The stabilizing features 214 may prevent tipping or rocking of the connector mounting bracket 200 relative to the panel 102. The stabilizing features 214 provide point of contact with the panel 102 separate from the mounting latches 210 and the centering latches 212. The stabilizing features 214 are configured to press against the rear of the panel 102, whereas the mounting latches 210 and the centering latches 212 are configured to press against the front of the panel 102.

Each stabilizing feature 214 includes a flange 260 that extends outward from the collar 202 (for example, extends upward from the top 222 or downward from the bottom 224). The flange 260 increases the height (or the width) of the connector mounting bracket 200. In an exemplary embodiment, the flange 260 includes a first leg 262 extending from the collar 202, a second leg 264 extending from the collar 202, and a beam 266 extending between the first and second legs 262, 264. The beam 266 is spaced apart from the collar 202 to form a slot 268 between the first and second legs 262, 264. The legs 262, 264 may be flexible to allow the flange 260 to interface with the panel 102. In an exemplary embodiment, the stabilizing feature 214 includes an engaging tab 270 extending from the beam 266 of the flange 260. The engaging tab 270 is configured to engage the rear of the panel 102 to press the collar 202 rearward away from the panel 102. The engaging tab 270 provides a point of contact between the stabilizing feature 214 and the panel 102. The engaging tab 270 extends forward of the beam 266 to interface with the panel 102. Optionally, the engaging tab 270 may extend forward of the front 230 of the collar 202 to ensure that the engaging tab 270 interfaces with the panel 102 and holds the collar 202 away from the panel 102. Other types of stabilizing features may be provided in alternative embodiments. The stabilizing features 214 may have other shapes in alternative embodiments.

Figure 4:
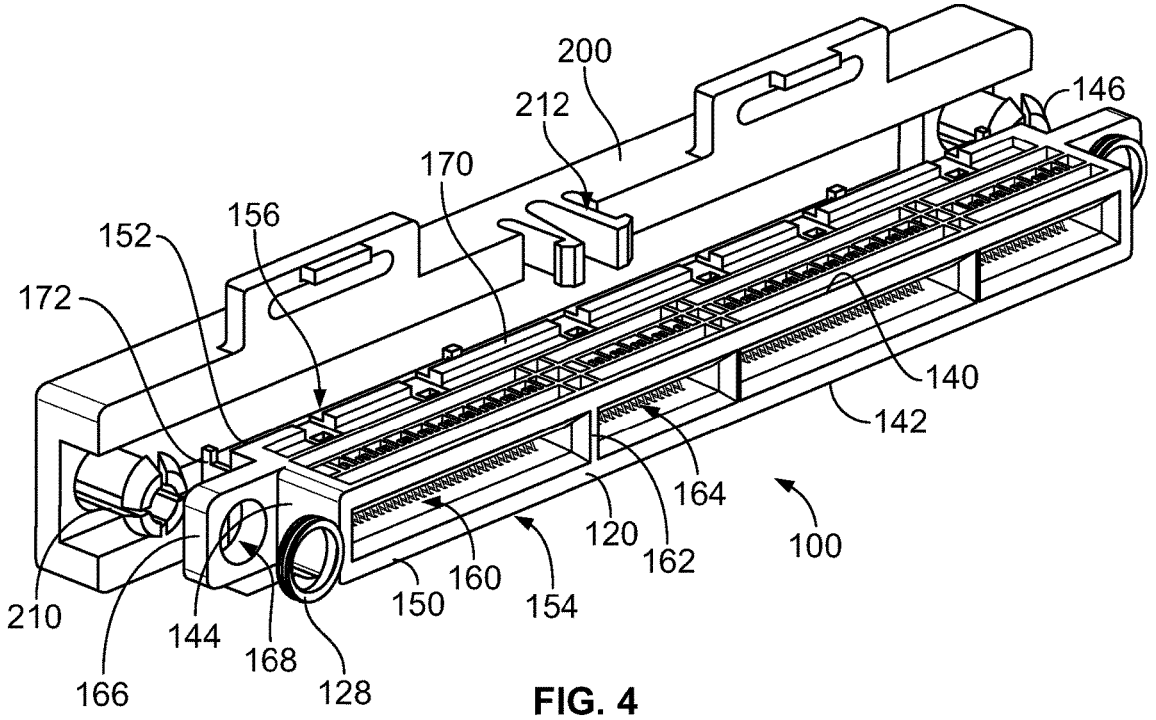
FIG. 4 is a front perspective, exploded view of a portion of the electrical connector assembly in accordance with an exemplary embodiment.

FIG. 4 is a front perspective, exploded view of a portion of the electrical connector assembly 100 showing the connector mounting bracket 200 poised for coupling to the housing 120. In an exemplary embodiment, the connector mounting bracket 200 is configured to be rear loaded into the housing 120. In an exemplary embodiment, the electrical connector assembly 100 includes biasing elements 128 configured to be coupled to the connector mounting bracket 200, such as after the connector mounting bracket 200 is coupled to the housing 120. In the illustrated embodiment, the biasing elements 128 are waves springs configured to be mounted to the mounting latches 210. The biasing elements 128 are configured to engage the panel 102 to provide a biasing force against the panel 102 to hold the mounting latches 210 and the centering latches 212 against the panel 102 by a spring force.

The housing 120 is manufactured from a dielectric material, such as a plastic material. In various embodiments, the housing 120 is a molded part. For example, the housing 120 may be manufactured by an injection molding process. The contacts 122 are configured to be loaded into the housing 120. In alternative embodiments, the housing 120 may be overmolded around the contacts 122.

The housing 120 includes a top 140 and a bottom 142 opposite the top 140. The housing 120 includes a first side 144 and a second side 146 opposite the first side 144. The housing 120 extends between a front 150 and a rear 152. In the illustrated embodiment, the housing 120 is generally rectangular shaped. For example, the housing 120 is elongated such that the top 140 and the bottom 142 are longer than the first and second sides 144, 146. The housing 120 may have other shapes in alternative embodiments. The housing 120 has a mating end 154 and a cable end 156. In the illustrated embodiment, the mating end 154 is defined by the front 150. The cable end 156 is defined by the rear 152. In alternative embodiments, the cable end 156 may be oriented perpendicular to the mating end, such as at the top 140 or the bottom 142.

In an exemplary embodiment, the housing 120 is a card edge housing having one or more card slots 160 configured to receive circuit cards. In the illustrated embodiment, four card slot 160 are provided across the mating end 154, which are separated by separating walls 162. The card slot 160 may have different widths to accommodate different size circuit cards. The contacts 122 are held in the housing 120 to interface with the circuit cards when the circuit cards are plugged into the card slot 160. For example, the contacts 122 may be arranged in rows both above and below the card slot 160 to interface with top and bottom surfaces of the circuit card. In an exemplary embodiment, the contacts 122 are held in corresponding contact channels 164 of the housing 120. The contacts 122 extend from the mating end 154 to the cable end 156 to interface with the cables 124 (shown in FIGS. 1 and 2). For example, the contacts 122 may be terminated directly to conductors of the cables. The contacts 122 may be soldered to the conductors, crimped to the conductors or otherwise mechanically and electrically connected to the conductors. The contacts may be terminated to other conductors, such as a lead frame or a circuit card within the housing 120. Optionally, the contacts 122 includes signal contacts and ground contacts. The signal contacts are electrically connected to signal conductors of the cables 124 and the ground contacts are electrically connected to the outer contact support cable shields of the cables 124.

In an exemplary embodiment, the housing 120 includes mounting tabs 166 at the first and second sides 144, 146. The mounting tabs 166 are configured to be mounted to the connector mounting bracket 200. In the illustrated embodiment, the mounting tabs 166 includes mounting openings 168 that receive the mounting latches 210. Other types of securing features may be provided in alternative embodiments to couple the connector mounting bracket 200 to the housing 120.

In an exemplary embodiment, the housing 120 includes locating ribs 170. The locating ribs 170 are used to locate the connector mounting bracket 200 relative to the housing 120. In the illustrated embodiment, the locating ribs 170 extend along the top 140 and the bottom 142 at the locating ribs 170 are located proximate to the rear 152. The connector mounting bracket 200 is rear loaded onto the housing 120 and engages the locating ribs 170 to locate the connector mounting bracket 200 relative to the housing 120. Other types of locating features may be used in alternative embodiments.

In an exemplary embodiment, the housing 120 includes attachment ribs 172 extending from the rear 152. The attachment ribs 172 are used to attach the cable holder 126 (shown in FIG. 5) to the housing 120. The attachment ribs 172 are sized and shaped to receive the cable holder 126. In an exemplary embodiment, the attachment ribs 172 include features for retaining the cable holder 126 on the housing 120. For example, shoulders or step features may be provided to retain the cable holder 126 on the housing 120.

Figure 5:
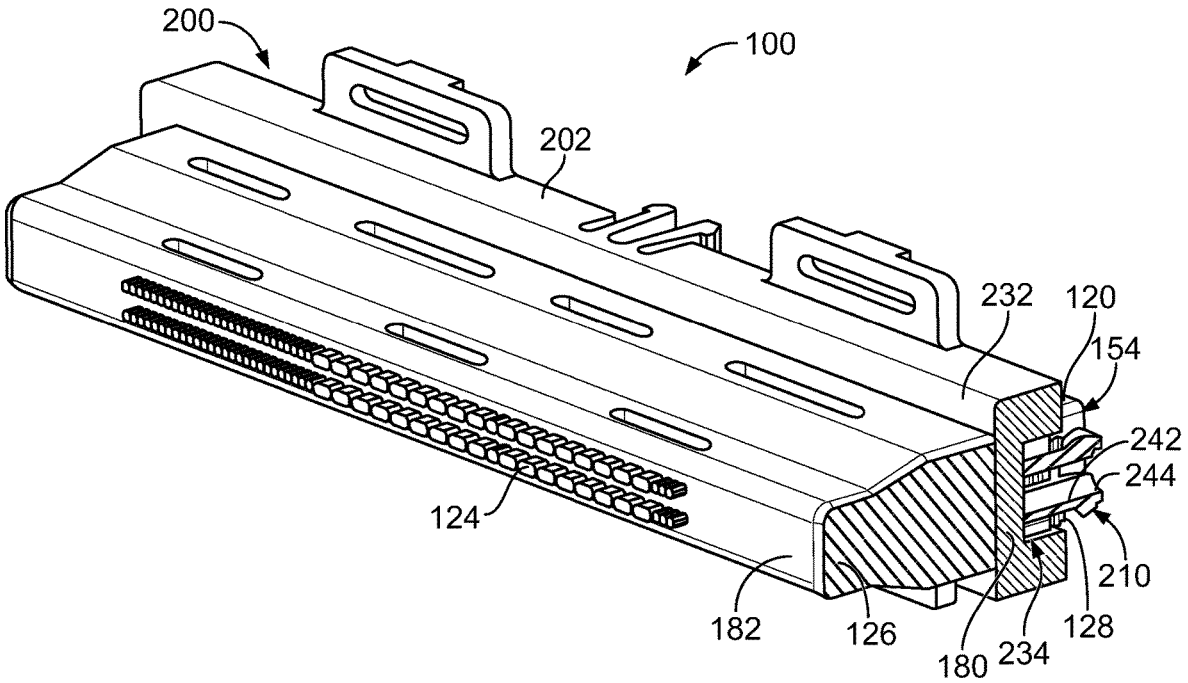
FIG. 5 is a rear perspective view of the electrical connector assembly in accordance with an exemplary embodiment.
Figure 6:
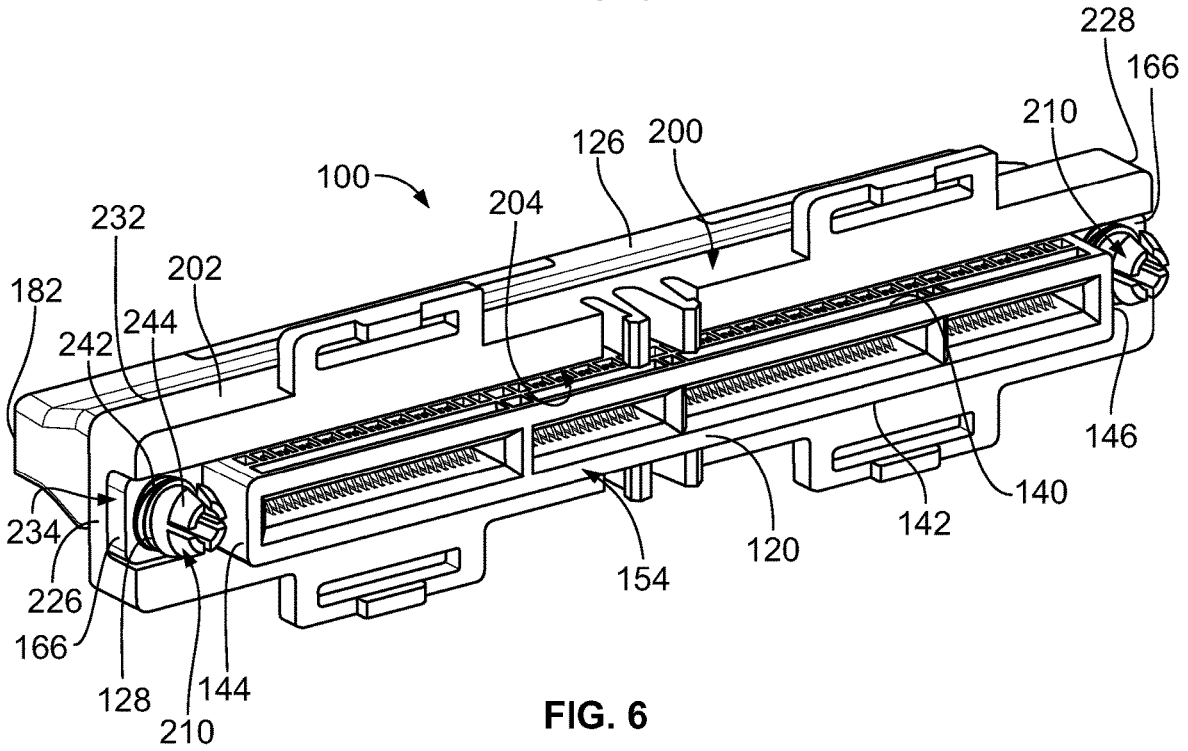
FIG. 6 is a front perspective view of the electrical connector assembly in accordance with an exemplary embodiment.

FIG. 5 is a rear perspective view of the electrical connector assembly 100 in accordance with an exemplary embodiment. FIG. 6 is a front perspective view of the electrical connector assembly 100 in accordance with an exemplary embodiment. FIGS. 5 and 6 illustrates the electrical connector assembly 100 in an assembled state. FIGS. 5 and 6 illustrate the connector mounting bracket 200 coupled to the housing 120 and the cable holder 126 coupled to the housing 120.

During assembly, the connector mounting bracket 200 is rear loaded onto the housing 120. The housing 120 is received in the window 204. The front portion of the housing 120, such as the mating end 154, extends forward of the collar 202. The rear portion of the housing 120 extends through the window 204 and may extend rearward of the collar 202. The collar 202 surrounds the housing 120 (for example, above the top 140, below the bottom 142, and a round or along the first and second sides 144, 146). In an exemplary embodiment, the mounting tabs 166 are received in the pockets 234 at the first and second sides 226, 228 of the collar 202. The mounting latches 210 are pressed through the mounting openings 168 in the mounting tabs 166. The biasing elements 128 are coupled to the mounting latches 210. For example, the biasing elements 128 may be front loaded onto the mounting latches 210 after the mounting latches 210 are pressed through the mounting tabs 166. The biasing elements 128 surround the posts 242 and are retained rearward of the heads 244 of the mounting latches 210.

In an exemplary embodiment, after the connector mounting bracket 200 is coupled to the housing 120, the cable holder 126 is coupled to the housing 120 behind the connector mounting bracket 200. The cable holder 126 is used to retain the connector mounting bracket 200 on the housing 120. For example, the connector mounting bracket 200 is captured between the attachment ribs 172 of the housing 120 and the cable holder 126. In an exemplary embodiment, the cable holder 126 is configured to be overmolded in place on to the housing 120 around the cables 124 to provide strain relief for the cables 124. The cable holder 126 is molded onto the attachment ribs 172 (shown in FIG. 4) to permanently secure the cable holder 126 to the housing 120. In an exemplary embodiment, the cable holder 126 is applied to the housing 120 after the connector mounting bracket 200 is secured in place to the housing 120. The cable holder 126 is used to capture the connector mounting bracket 200 onto the rear 152 of the housing 120. The cable holder 126 blocks removal of the connector mounting bracket 200 from the housing 120. The cable holder 126 includes a front 180 that engages the rear 232 of the connector mounting bracket 200. The cables 124 extend from a rear 182 of the cable holder 126. Optionally, during the overmolded process, portions of the cable holder 126 may extend into the connector mounting bracket 200, such as into the window 204 to lock the cable holder 126 to the connector mounting bracket 200.

Figure 7:
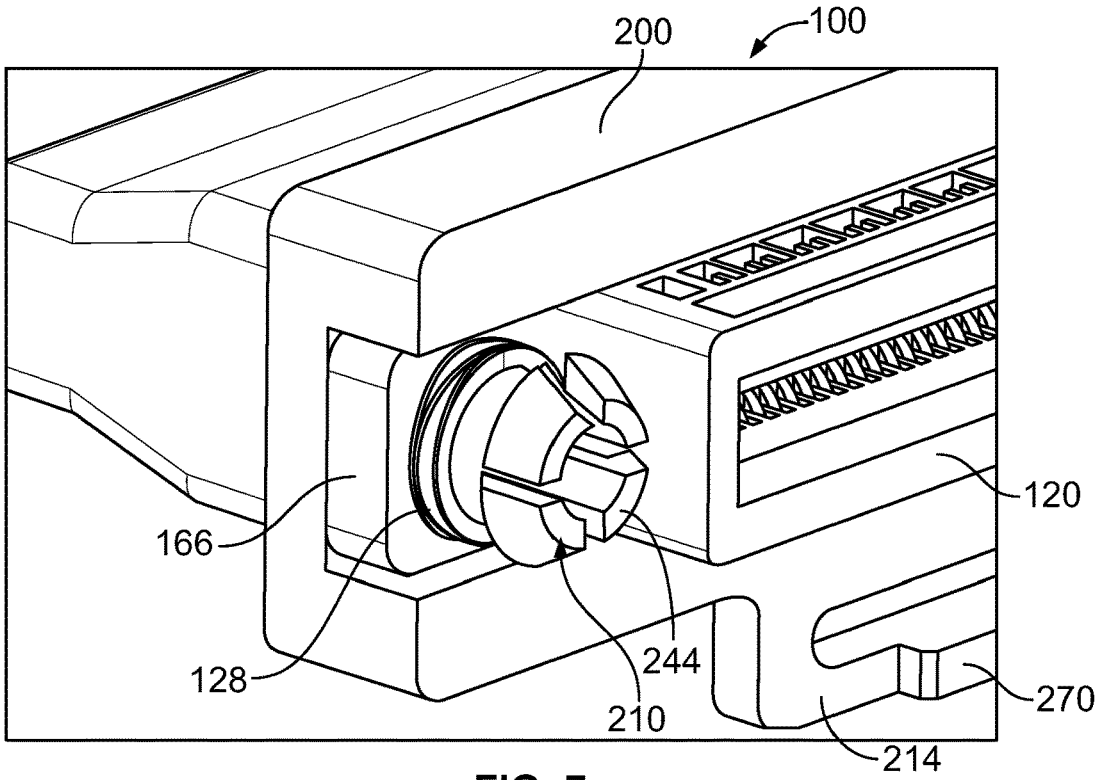
FIG. 7 is an enlarged view of a portion of the electrical connector assembly in accordance with an exemplary embodiment.

FIG. 7 is an enlarged view of a portion of the electrical connector assembly 100 in accordance with an exemplary embodiment. FIG. 7 illustrates the connector mounting bracket 200 coupled to the housing 120. The mounting latches 210 extends through the mounting opening 168 and the mounting tab 166. The biasing element 128 is coupled to the mounting latches 210. The biasing element 128 is located between the mounting tab 166 and the head 244 of the mounting latches 210. The biasing element 128 is compressible. In the illustrated embodiment, the biasing element 128 is a wave spring. Other types of biasing elements may be used in alternative embodiments, such as a coil spring, in the spring, or another type of biasing element. The biasing element 128 may be coupled to another structure of the connector mounting bracket 200 and/or the housing 120 in alternative embodiments.

Figure 8:
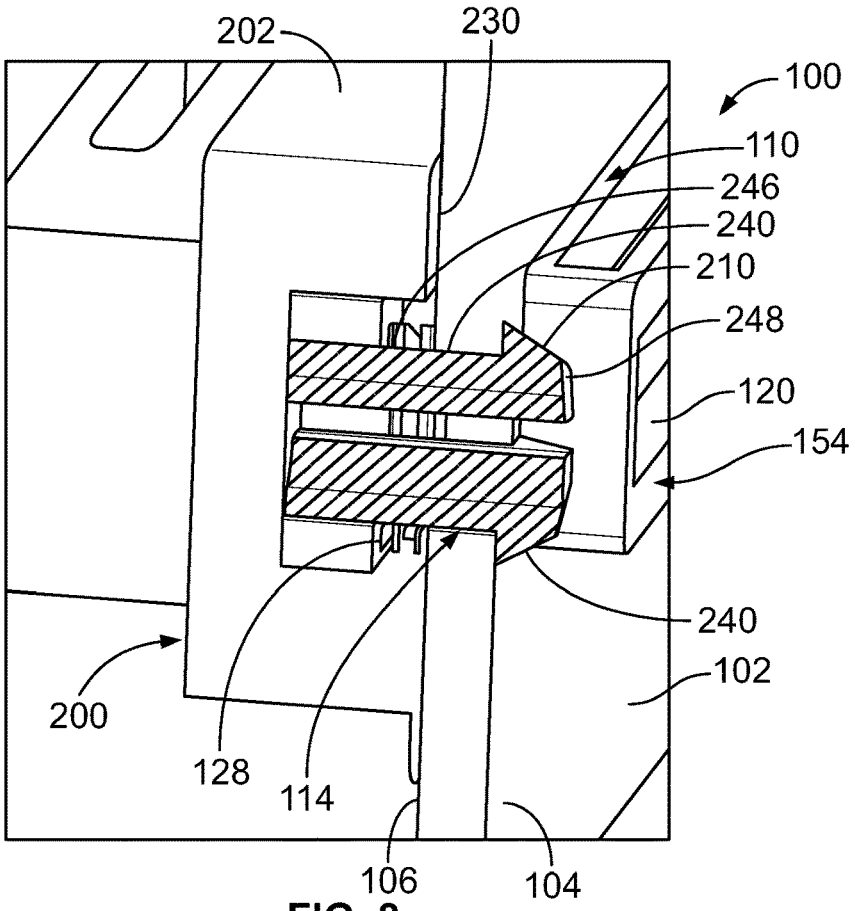
FIG. 8 is a cross-sectional view of a portion of the electrical connector assembly mounted to the panel in accordance with an exemplary embodiment.

FIG. 8 is a cross-sectional view of a portion of the electrical connector assembly 100 mounted to the panel 102. The mating end 154 of the housing 120 passes through the panel opening 110 in the panel 102 and is exposed forward of the panel 102 for mating with the mating electrical connector. The electrical connector assembly 100 is configured to be mounted to the panel 102 without the use of additional mounting hardware. The electrical connector assembly 100 is configured to be mounted to the panel 102 without the use of additional tooling. In an exemplary embodiment, the electrical connector assembly 100 is configured to be snap coupled or clipped to the panel 102 from behind the panel 102 using the integral latching features of the connector mounting bracket 200 of the electrical connector assembly 100.

During assembly to the panel 102, the mounting latch 210 is configured to be plugged into the mounting opening 114 to latchably secure the connector mounting bracket 200 to the panel 102. During assembly, the latch beams 246 are deflected inward to allow the latch flanges 248 to pass through the mounting opening 114 to the front 104 of the panel 102. Once the latch flanges 248 pass through the mounting opening 114, the latching features 240 step outward and the latch flanges 248 engage the front 104 of the panel 102.

The biasing element 128 is compressed during mating. The biasing element 128 presses against the rear 106 of the panel 102. The biasing element 128 pushes the panel 102 forward to maintain positive pressure between the front 104 of the panel 102 and the latch flanges 248 of the mounting latch 210. The biasing element 128 may push the panel 102 forward relative to the front 230 of the collar 202. For example, a gap may be formed between the front 230 of the collar 202 and the rear 106 of the panel 102. In an exemplary embodiment, the stabilizing features 214 (shown in FIG. 7) are used to stabilize the connector mounting bracket 200 relative to the panel 102. For example, when the panel 102 is pushed forward of the front 230 of the collar 202, the stabilizing features 214, with the engagement tabs 270 that protrudes from the front of the stabilizing features 214, engage the panel 102 and prevent rocking or tipping of the electrical connector assembly 100 relative to the panel 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembly configured to be mounted to a panel in a panel opening, the electrical connector assembly comprising:

a housing having a mating end and a cable end, the housing having a card slot at the mating end configured to receive a circuit card, the mating end configured to pass through the panel opening and presented forward of the panel for receiving the circuit card, the housing configured to extend from the panel with the cable end rearward of the panel;

contacts held in the housing, the contacts having contact mating ends provided at the card slot for mating with the circuit card, the contacts having terminating ends opposite the contact mating ends, the contacts having contact bodies extending between the contact mating ends and the terminating ends;

cables terminated to the terminating ends of corresponding contacts, the cables extending from the cable end of the housing; and a connector mounting bracket having a collar surrounding the housing, the collar having a window receiving the housing, the connector mounting bracket having mounting latches extending from the collar, the mounting latches including latch fingers configured to be coupled to a front of the panel to secure the connector mounting bracket to a rear of the panel, the connector mounting bracket including a biasing element configured to engage the rear of the panel to bias the latch fingers of the mounting latches against the front of the panel.

2. The electrical connector assembly of claim 1, wherein the connector mounting bracket is separate and discrete from the housing, the connector mounting bracket being coupled to the housing during assembly.

3. The electrical connector assembly of claim 1, wherein the collar completely surrounds the window and the housing on a top, a bottom, a first side, and a second side.

4. The electrical connector assembly of claim 1, wherein the mounting latches are provided at first and second sides of the collar.

5. The electrical connector assembly of claim 1, wherein each mounting latch includes a plurality of the latch fingers independently movable relative to each other.

6. The electrical connector assembly of claim 1, wherein each mounting latch includes a post and a head formed by at least one of the latch fingers, the head being enlarged relative to the post, the head configured to pass through a mounting opening of the panel to engage a front of the panel.

7. The electrical connector assembly of claim 1, wherein the connector mounting bracket includes a centering latch extending from a front of the collar, the centering latch having a first latch beam and a first latch finger at a distal end of the first latch beam, the first latch beam configured to extend through a latch opening in the panel, the first latch finger configured to engage a front of the panel, the centering latch having a second latch beam and a second latch finger at a distal end of the second latch beam, the second latch beam configured to extend through the latch opening in the panel, the second latch finger configured to engage the front of the panel, wherein the first latch beam biases the connector mounting bracket in a first direction and the second latch beam biases the connector mounting bracket and a second direction opposite the first direction.

8. The electrical connector assembly of claim 1, further comprising a cable holder coupled to the cable end of the housing, the cable holder surrounding the cables and providing strain relief for the cables, the cable holder being coupled to the housing to capture the connector mounting bracket between the housing of the cable holder.

9. The electrical connector assembly of claim 8, wherein the cable holder includes an overmold boot molded in place over the cables against the connector mounting bracket.

10. The electrical connector assembly of claim 8, wherein the housing includes locating ribs, the collar be loaded onto the housing against the locating ribs, the cable holder holding the collar against the locating ribs.

11. The electrical connector assembly of claim 8, wherein the collar is a rear loaded onto the housing, the cable holder being coupled to a rear of the housing behind the collar.

12. The electrical connector assembly of claim 1, wherein the connector mounting bracket includes a stabilizing feature extending from the collar, the stabilizing feature configured to engage the panel to stabilize the collar relative to the panel.

13. The electrical connector assembly of claim 12, wherein the stabilizing feature is an upper stabilizing feature extending from a top of the collar, the connector mounting bracket further comprising a lower stabilizing feature extending from a bottom of the collar configured to engage the panel to stabilize the collar relative to the panel.

14. The electrical connector assembly of claim 12, wherein the stabilizing feature includes a flange increasing at least one of a height or a width of the connector mounting bracket.

15. The electrical connector assembly of claim 14, wherein the stabilizing feature includes an engaging tab extending from the flange, the engaging tab configured to engage a rear of the panel to press the collar rearward away from the panel.

16. The electrical connector assembly of claim 12, wherein the stabilizing feature includes a first leg extending from the collar, a second leg extending from the collar, and a beam extending between the first leg and the second leg, the stabilizing feature including a slot between the first and second legs.

17. An electrical connector assembly configured to be mounted to a panel in a panel opening, the electrical connector assembly comprising:

a housing having a mating end and a cable end, the housing having a card slot at the mating end configured to receive a circuit card, the mating end configured to pass through the panel opening and presented forward of the panel for receiving the circuit card, the housing configured to extend from the panel with the cable end rearward of the panel;

contacts held in the housing, the contacts having contact mating ends provided at the card slot for mating with the circuit card, the contacts having terminating ends opposite the contact mating ends, the contacts having contact bodies extending between the contact mating ends and the terminating ends;

cables terminated to the terminating ends of corresponding contacts, the cables extending from the cable end of the housing;

a cable holder coupled to the cable end of the housing, the cable holder surrounding the cables and providing strain relief for the cables; and a connector mounting bracket having a collar surrounding the housing, the collar having a window receiving the housing, the connector mounting bracket having mounting latches extending from the collar, the mounting latches including latch fingers configured to be coupled to a front of the panel to secure the connector mounting bracket to a rear of the panel, the connector mounting bracket including a biasing element configured to engage the rear of the panel to bias the latch fingers of the mounting latches against the front of the panel, wherein the collar of the connector mounting bracket is captured between the housing and the cable holder.

18. The electrical connector assembly of claim 17, wherein the cable holder includes an overmold boot molded in place over the cables against the connector mounting bracket.

19. An electrical connector assembly configured to be mounted to a panel in a panel opening, the electrical connector assembly comprising:

a housing having a mating end and a cable end, the housing having a card slot at the mating end configured to receive a circuit card, the mating end configured to pass through the panel opening and presented forward of the panel for receiving the circuit card, the housing configured to extend from the panel with the cable end rearward of the panel;

contacts held in the housing, the contacts having contact mating ends provided at the card slot for mating with the circuit card, the contacts having terminating ends opposite the contact mating ends, the contacts having contact bodies extending between the contact mating ends and the terminating ends;

cables terminated to the terminating ends of corresponding contacts, the cables extending from the cable end of the housing; and a connector mounting bracket having a collar surrounding the housing, the collar extending between a first side and a second side, the collar having a front and a rear, the collar having a window between the front and the rear, the window receiving the housing, the connector mounting bracket including a stabilizing feature configured to engage the panel to stabilize the collar relative to the panel, the connector mounting bracket having a first mounting latch at the first side and a second mounting latch at the second side, the first and second mounting latches extending forward from the front of the collar to secure the connector mounting bracket to the rear of the panel, the connector mounting bracket including a biasing element configured to engage the panel to bias the panel against the mounting latches.

20. The electrical connector assembly of claim 19, wherein the stabilizing feature includes a first leg extending from the collar, a second leg extending from the collar, and a beam extending between the first leg and the second leg, the stabilizing feature including a slot between the first and second legs, the stabilizing feature including an engaging tab extending from the beam, the engaging tab configured to engage a rear of the panel to press the collar rearward away from the panel.

* * * * *